US008441370B2

(12) United States Patent
Bonavides et al.

(10) Patent No.: US 8,441,370 B2
(45) Date of Patent: May 14, 2013

(54) ACTUATING DOWNHOLE DEVICES IN A WELLBORE

(75) Inventors: Clovis S. Bonavides, Houston, TX (US); Donald L. Crawford, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/616,326

(22) Filed: Sep. 14, 2012

(65) Prior Publication Data

US 2013/0010572 A1 Jan. 10, 2013

Related U.S. Application Data

(62) Division of application No. 12/244,316, filed on Oct. 2, 2008.

(51) Int. Cl.
*G01V 3/00* (2006.01)

(52) U.S. Cl.
USPC ..... 340/855.7; 340/853.3; 340/855.4; 166/250.01

(58) Field of Classification Search ..... 340/853.3, 340/855.4, 855.7; 166/250.01
See application file for complete search history.

(56) References Cited

U.S. PATENT DOCUMENTS

| | | | |
|---|---|---|---|
| 4,884,506 | A | 12/1989 | Guerreri |
| 6,478,090 | B2 | 11/2002 | Deaton |
| 6,604,584 | B2 | 8/2003 | Lerche et al. |
| 7,980,309 | B2 | 7/2011 | Crawford |
| 8,074,737 | B2 | 12/2011 | Hill et al. |
| 2001/0043509 | A1 | 11/2001 | Green et al. |
| 2003/0000706 | A1 | 1/2003 | Carstensen |
| 2003/0015319 | A1 | 1/2003 | Green et al. |
| 2005/0022987 | A1 | 2/2005 | Green et al. |
| 2005/0045331 | A1 | 3/2005 | Lerche et al. |
| 2005/0046592 | A1 | 3/2005 | Cooper et al. |
| 2006/0039238 | A1 | 2/2006 | Mandal et al. |
| 2007/0019506 | A1 | 1/2007 | Mandal et al. |
| 2007/0096941 | A1 | 5/2007 | Morys |
| 2007/0152054 | A1 | 7/2007 | Bonavides et al. |
| 2009/0272529 | A1 | 11/2009 | Crawford |
| 2010/0005992 | A1 | 1/2010 | Crawford |

*Primary Examiner* — Shane Bomar
*Assistant Examiner* — Catherine Loikith
(74) *Attorney, Agent, or Firm* — Paul I. Herman; Fish & Richardson P.C.

(57) ABSTRACT

A downhole tool system includes a first downhole tool and a second downhole tool. The first downhole tool includes a first controller operable to receive an actuation signal including a tone. The first controller actuates the first downhole tool if the tone is a first specified frequency and changes the first downhole tool to communicate the actuation signal to the second downhole tool if first downhole tool is not actuated in response to the actuation signal. A second downhole tool includes a second controller operable to receive the actuation signal. The second controller actuates the second downhole tool if the tone is a second specified frequency. The second frequency is different from the first frequency.

18 Claims, 6 Drawing Sheets

ACTUATING DOWNHOLE DEVICES IN A WELLBORE

BACKGROUND

This disclosure relates to actuating downhole devices in a wellbore and, more particularly, actuating downhole devices over a wireline by a tonal signal.

Downhole tools and devices utilized in a wellbore may accomplish a number of different tasks. For example, some downhole tools are used for perforating the wellbore to allow fluids from the geological formation to enter the wellbore and eventually be produced. Downhole tools may also be utilized to measure various characteristics of the geological formation surrounding the wellbore; introduce cement, sand, acids, or other chemicals to the wellbore; and perform other operations.

In certain instances, downhole tools, such as explosive perforating tools, or "guns," utilize a combination of changing voltage polarity and pressure actuated switches in order to activate. For example, a downhole tool may consist of a string of guns physically and electrically connected by a wireline in the wellbore and positioned vertically in the wellbore at a particular depth. In order to activate the first gun in the string, i.e., the deepest gun in the string, a positive voltage signal may be transmitted via the wireline to the first gun, actuating the gun and causing the explosive charge to detonate. A pressure-actuated mechanical switching switch may then shift to allow negative polarity only through the wireline. The second gun in the string, i.e., the next deepest gun in the string, may only be actuated with negative polarity. Once the second gun is actuated by transmitting negative polarity through the wireline, the pressure-actuated mechanical switching switch may shift to allow only positive polarity voltage through the wireline. The third gun in the string may only be actuated with positive voltage. The foregoing sequence of positive and negative voltage actuated tools may be repeated for any number of tools. The pressure actuated mechanical switching switch, however, may be shifted accidentally due to formation characteristics. Moreover, guns actuated by switching polarity may be prone to accidental actuation.

SUMMARY

In certain aspects, a downhole tool system includes a first downhole tool and a second downhole tool. The first downhole tool includes a first controller operable to receive an actuation signal including a tone. The first controller actuates the first downhole tool if the tone is a first specified frequency and changes the first downhole tool to communicate the actuation signal to the second downhole tool if first downhole tool is not actuated in response to the actuation signal. A second downhole tool includes a second controller operable to receive the actuation signal. The second controller actuates the second downhole tool if the tone is a second specified frequency. The second frequency is different from the first frequency.

Certain aspects encompass a method for actuating a downhole tool in a well bore. In the method, power for tool actuation and a first actuation signal including a first tone is received at a first downhole tool. A frequency of the first tone in the first actuation signal is compared to a first reference frequency. The first downhole tool is actuated in response to the comparison of the first actuation signal and the first reference frequency. Power for tool actuation and a second actuation signal including a second tone is received at a second downhole tool. The frequency of the second tone in the second actuation signal is compared to a second reference frequency. The second downhole tool is actuated in response to the comparison of the second actuation signal and the second reference frequency.

Certain aspects encompass a method for actuating a downhole tool in a well bore. In the method, a tonal signal and power for actuating the downhole tool is received at the downhole tool. It is determined whether the tonal signal corresponds to the downhole tool by comparing a frequency of the tonal signal to a reference frequency associated with the downhole tool. Based upon the determination of whether the tonal signal corresponds to the downhole tool, the downhole tool is changed to apply the power to actuate the downhole tool.

Additionally, all or some or none of the described implementations may have one or more of the following features or advantages. For example, downhole tools may be actuated by a surface command over a mono-conductor wireline path. Also, downhole tools may be actuated singularly using tonal signals that serve both as the signal to actuate and to address a specific tool. As another example, downhole tools may be actuated by such a tonal signal involving a pattern of frequencies. In certain instances, a different specified or reference frequency can be uniquely associated with a given downhole device, controller and/or tool of the string in the wellbore. As a further example, downhole tools actuated by tonal signals may be less prone to accidental actuation due to random signals or random events. Also, downhole tools actuated by tonal signals may be less sensitive to signal level fluctuations and generally less prone to signal decoding errors. As yet another example, downhole tools may not be accidentally actuated because the power can be transmitted only to the tools being actuated. Further, the downhole tools may include additional safety features such as actuation switches. As another example, a system including downhole tools may be more cost efficient by avoiding various mechanical and electrical complexities inherent with certain digital controls. As a further example, various components within the described implementations may be more size-efficient and more easily integrate with existing downhole tool technology. Additionally, downhole tools may be actuated without the use of communications protocols and a multi-wire bus. Also, a system for actuating downhole tools may, in part, utilize metallic housings of downhole tools as a ground reference of the system.

These general and specific aspects may be implemented using a device, system or method, or any combinations of devices, systems, or methods. The details of one or more implementations are set forth in the accompanying drawings and the description below. Other features, objects, and advantages will be apparent from the description and drawings, and from the claims.

DETAILED DESCRIPTION

This disclosure provides various implementations for actuating downhole devices and, more particularly, for actuating downhole devices by tonal signals over a transmission path. For example, a downhole device may include a downhole tool controller coupled to a downhole tool. Upon receipt of a tonal signal from a system controller at the surface or at another location (e.g., in the well bore) via the transmission path, the downhole tool controller compares the tonal signal to a specified signal associated with the downhole device to determine a match or other correspondence. In some instances, multiple downhole devices may be provided on the transmission path, and each downhole device may be associated with a different specified signal. The tonal signal may be a signal with a specified frequency and/or duration or a pattern of frequencies and/or durations. If no match or correspondence of the tonal signal is determined, the downhole device performs in a first manner. Upon a match or correspondence of the tonal signal, the downhole device may perform in a second, different manner. For example, in one implementation, if no match of the tonal signal is determined, the downhole tool of the downhole device can remain unchanged (e.g. not actuate). If a match between the signals is determined, the downhole tool of the downhole device can actuate. In some implementations, the downhole tool of the downhole device may receive power from the surface and transmit the power and the signal to the next downhole device if no match of the tonal signal is determined. Of note, performing in the first or the second manner can include not responding to the tonal signal whatsoever.

Figure 1:
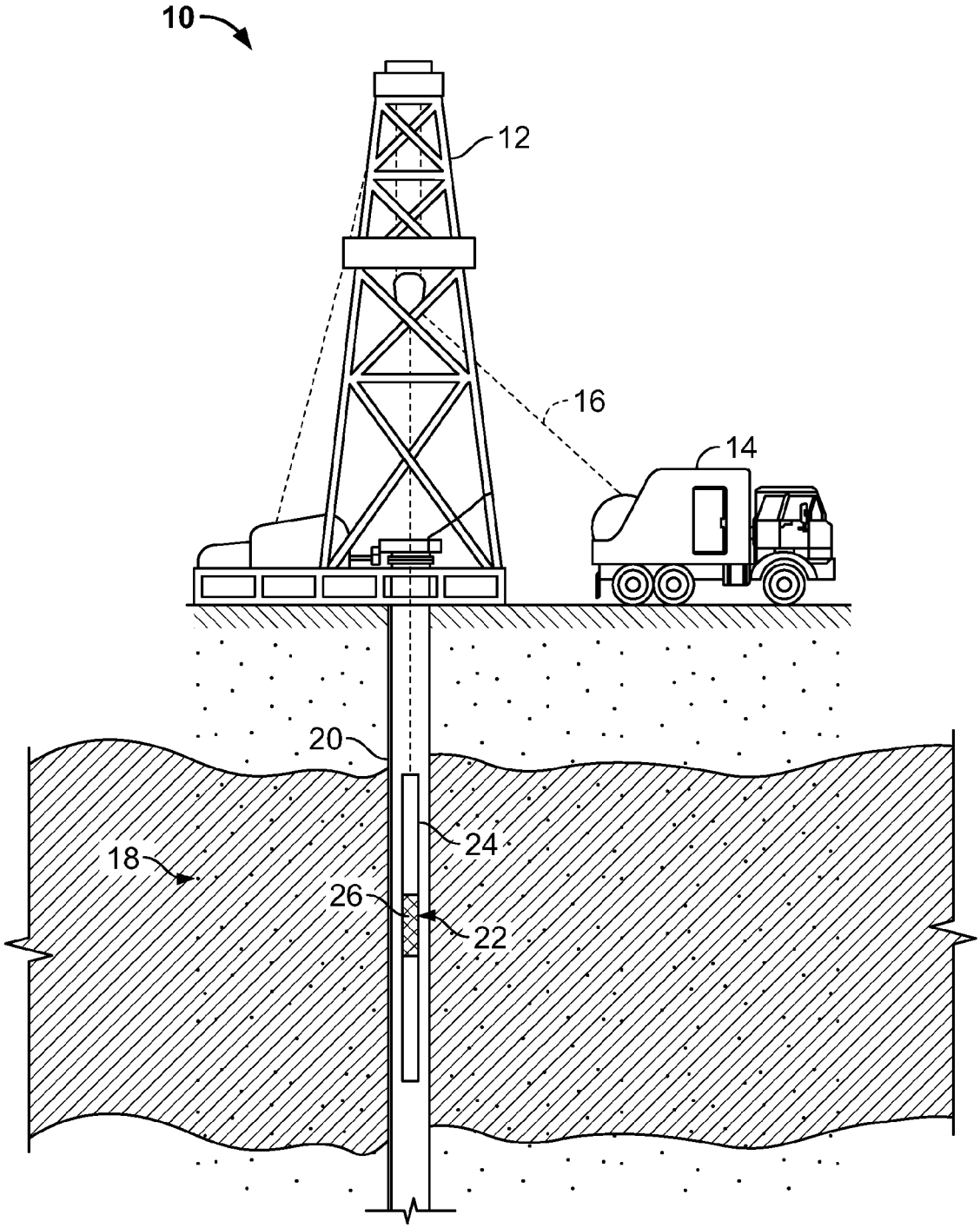
FIG. 1 illustrates one example of a well system which may utilize a downhole device in accordance with the concepts described herein.

FIG. 1 illustrates one example of a well system 10 which may utilize one or more implementations of a downhole device in accordance with the present disclosure. Well system 10 includes a drilling rig 12, a wireline truck 14, a wireline 16 (e.g., slickline, braided line, or electric line), a subterranean formation 18, a wellbore 20, and a downhole tool set 22. Drilling rig 12, generally, provides a structural support system and drilling equipment to create vertical or directional wellbores in sub-surface zones. As illustrated in FIG. 1, drilling rig 12 may create wellbore 20 in subterranean formation 18. Wellbore 20 may be a cased or open-hole completion borehole. Subterranean formation 18 is typically a petroleum bearing formation, such as, for instance, sandstone, Austin chalk, or coal, as just a few of many examples. Once the wellbore 20 is formed, wireline truck 14 may be utilized to insert the wireline 16 into the wellbore 20. The wireline 16 may be utilized to lower and suspend one or more of a variety of different downhole tools in the wellbore 20 for wellbore maintenance, logging, completion, workover, and other operations. In some instances, a tubing string may be alternatively, or additionally, utilized in lowering and suspending the downhole tools in the wellbore 20.

The downhole tools can include one or more of perforating tools (perforating guns), setting tools, sensor initiation tools, hydro-electrical device tools, pipe recovery tools, and/or other tools. Some examples of perforating tools include single guns, dual fire guns, multiple selections of selectable fire guns, and/or other perforating tools. Some examples of setting tools include electrical and/or hydraulics setting tools for setting plugs, packers, whipstock plugs, retrieve plugs, or perform other operations. Some examples of sensor initiation tools include tools for actuating memory pressure gauges, memory production logging tools, memory temperature tools, memory accelerometers, free point tools, logging sensors and other tools. Some examples of hydro-electrical device tools include devices to shift sleeves, set packers, set plugs, open ports, open laterals, set whipstocks, open whipstock plugs, pull plugs, dump beads, dump sand, dump cement, dump spacers, dump flushes, dump acids, dump chemicals or other actions. Some examples of pipe recovery tools include chemical cutters, radial torches, jet cutters, junk shots, string shots, tubing punchers, casing punchers, electromechanical actuators, electrical tubing punchers, electrical casing punchers and other pipe recover tools.

In the present example, tool set 22 may include one or more downhole devices 24. The downhole devices 24 may be coupled together with a threaded connector 26. In some implementations, the wireline 16 is the transmission path and downhole devices 24 may be actuated by one or more signals over the wireline 16 according to the concepts described herein. In certain implementations, the transmission path can take additional or alternative forms (e.g., electrical, fiber optic or other type of communication line carried apart from the wireline 16, electrical, fiber optic or other type of communication line carried in or on tubing, or other transmission paths).

Figure 2:
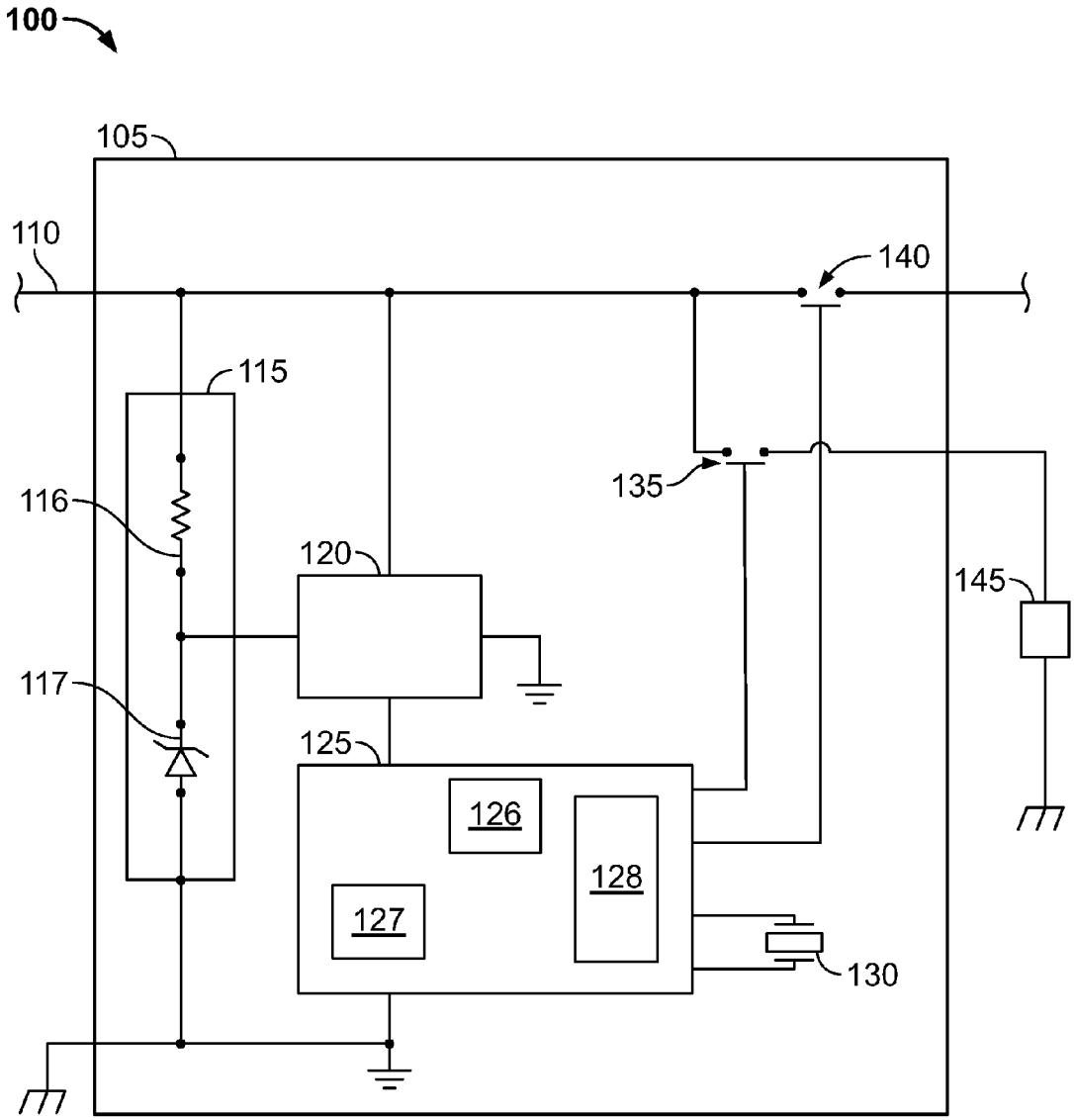
FIG. 2 is a block diagram illustrating a general implementation of a downhole device in accordance with the concepts described herein.

FIG. 2 is a block diagram illustrating one example of a downhole device 100 operable for placement within a wellbore used, for instance, as an oil well or gas well. Generally, downhole device 100 includes a downhole tool 145 and a tool controller 105, where the tool controller 105 is coupled to a transmission path 110. The tool controller 105 receives a actuation signal comprising a tone (referred to herein as a "tonal signal") via the transmission path 110 and compares the tonal signal to a specified reference signal (e.g. a specified reference tone or tones and/or a specified reference duration) associated with the downhole device. If the tonal signal received via the transmission path 110 matches or otherwise corresponds to the specified reference signal, the tool controller 105 acts (or refrains from acting) to cause the downhole tool 145 to perform in a first manner. If the signals do not match or correspond, the tool controller 105 acts (or refrains from acting) to cause the downhole tool 145 to perform in a second, different manner. In some instances, as is described in more detail below, the first manner of performance can be actuating the downhole tool and the second manner of performance can be not actuating the downhole tool. The tool controller 105 can determine signals do not match and relay the signal to another downhole device 100.

The tonal signal can be a single tone of a given frequency or may have multiple tones of the same and/or different frequencies. In tonal signals having multiple tones, each tone may have the same and/or different time durations. Different combinations of the number of tones, the frequency of the tones and the duration of the tones may be used to address different of the downhole devices. In an example using a single tone to address and actuate a specific downhole device, the specified reference signal associated with the specific downhole device can be a single specified reference frequency. If duration is taken into account, the specified reference signal can also include a specified time duration or a minimum specified time duration. For example, the downhole device can be configured to perform in the first manner only after receiving a tonal signal that matches in frequency and duration to its specified reference signal. The specified reference signal (frequencies and/or duration) can be unique from other specified reference signals associated with other downhole devices on the same transmission path. Unlike a binary tonal system, the system described herein can utilize three or more and/or five or more different frequencies. In certain instances, there can be at least one unique specified reference signal per downhole device on the transmission path (e.g., five downhole devices can utilize five different specified reference signals). In certain instances, groups of two or more downhole devices on a transmission path can be responsive in the first manner to the same tonal signal. In certain instances, one or more of the downhole tools on a transmission path are responsive in the first manner only to a specified frequency or a plurality of specified frequencies each played for specified durations.

The frequencies may be of any value and for any time duration (e.g., seconds, milliseconds, etc.). In certain instances, the duration of a tone is 0.5 s or greater. In certain instances, the frequencies can correspond to the frequencies used in telephone networks (2, 3, 4, 5, 6, 7, 8, 9, 10, 11 and 12 kHz). Although referred to as "tonal," the tonal signals need not be audible or within the frequency range of sounds audible to a human.

In this example, the downhole device 100 the transmission path 110 transmits both power to power and actuate the downhole tool 145 and the tonal signal. In some instances, the transmission path 110 may omit power or may provide power enough to operate the tool controller 105 but not enough to actuate the tool 145. In some aspects, the downhole device 100 may consist of a downhole tool 145 integrally coupled to a tool controller 105 such that, for example, at least portions of the downhole tool 145 and tool controller 105 are enclosed within a common housing. In certain instances, the downhole tool 145 and tool controller 105 can be provided partially or wholly in two or more separate housings.

The example tool controller 105 includes a power module 115, a processor module 125, a crystal oscillator 130, an actuation switch 135, and a power-control switch (PCS) 140. The tool controller 105 may also include a signal conditioner 120. The power module 115 consists of a resistor 116 in series with a Zener diode 117 and receives power via the transmission path 110 to supply power to the tool controller 105 and its components. Signal conditioner 120 may be coupled from the transmission path 110 to the processor module 125 and generally acts as an analog filter for signals transmitted to the tool controller 105 via the transmission path 110. For example, the tool controller 105 may actuate the downhole tool 145 upon receipt of a tonal signal. The signal conditioner 120, when implemented, may filter undesirable frequency variations from the tonal signal and provide a cleaner frequency signal to the processor module 125. In some implementations, the signal conditioner 120 may consist of one or more capacitors.

Processor module 125 is coupled to the power module 115, crystal oscillator 130, actuation switch 135, and PCS 140. The processor module 125 may also be coupled to the signal conditioner 120. Generally, the processor module 125 controls the actuation switch 135 and PCS 140 based on the tonal signal received through transmission path 110 by executing instructions and manipulating data to perform the operations of the tool controller 105. Processor module 125 may be, for example, a central processing unit (CPU), an application specific integrated circuit (ASIC), a field-programmable gate array (FPGA) and/or other type of processor. Although FIG. 2 illustrates a single processor module 125 in tool controller 105, multiple processor modules 125 may be used according to particular needs and reference to processor module 125 is meant to include multiple processors 125 where applicable.

The processor module 125 includes or is communicably coupled to a signal decoder 126, memory 127, and a control circuit 128. As shown in FIG. 2, the signal decoder 126, memory 127, and control circuit 128 may be integral to the processor module 125. In some aspects, however, the decoder 126, memory 127, and control circuit 128 may be physically separated yet communicably coupled to each other, as well as, the processor module 125. The signal decoder 126 includes logic and software and, generally, receives the tonal signal via the transmission path 110 and decodes the signal for comparison to a stored signal in the memory 127. Regardless of the particular implementation, "software" may include software, firmware, wired or programmed hardware, or any combination thereof.

Memory 127 may include any memory or database module and may take the form of volatile or non-volatile memory including, without limitation, flash memory, magnetic media, optical media, random access memory (RAM), read-only memory (ROM), removable media, or any other local or remote memory component. Furthermore, although illustrated in FIG. 2 as a single memory 127, multiple memory modules 127 may be utilized in the tool controller 105. Memory 127, generally, stores instructions and routines executed by the processor module 125 to, for example, decode the tonal signal transmitted to the tool controller 105, compare the tonal signal to the stored reference signal residing in memory 127, and control the operation of the actuation switch 135 and PCS 140. In short, the memory 127 may store data and software executed by the processor module 125 to operate and control the tool controller 105.

Control circuit 128 includes analog and/or digital circuitry operable to control the actuation switch 135 and PCS 140 based on the tonal signal received via the transmission path 110 and the operation of the processor module 125. Generally, the control circuit 128 operates to close the actuation switch 135 based on a match of the tonal signal transmitted to the tool controller 105 and the stored signal in memory 127. The control circuit 128 also operates to close the PCS 140 if the tonal signal does not match the stored signal.

Continuing with FIG. 2, the tool controller 105 may also include crystal oscillator 130 coupled to the processor module 125. In some embodiments, the tonal signal may be a frequency signal transmitted to the tool controller 105. The crystal oscillator 130, such as a piezoelectric crystal resonator, can provide a reliable frequency reference that may be utilized by the signal decoder 126 to perform reliable frequency measurements. In some instances, two or more crystal oscillators 130 can be included in the tool controller 105.

Actuation switch 135 is coupled to the transmission path 110, the processor module 125, and a downhole tool 145. When closed, the actuation switch 135 provides power from the transmission path 110 to the downhole tool 145, thus activating the downhole tool 145. In some instances, the downhole tool 145 may be a perforating tool including a detonating explosive charge. In such instances, the actuation switch 135 may be rated at 180 volts and 0.001 amps to accommodate a high-voltage, low-current detonator. The actuation switch 135 may also be rated to accommodate a low-voltage, high-current detonator, such as a switch 135 rated at 42 volts and 0.8 amps. Actuation switch 135, however, may be sized to accommodate both high-voltage and high-current, thereby allowing it to function with either type of detonator.

PCS 140 is coupled to the transmission path 110 and the processor module 125, and generally, operates to interrupt or allow power to be transmitted on the transmission path 110 past the tool controller 105. For example, in some instances, multiple tool controllers 105 may be coupled to the transmission path 110. If the processor module 125 operates the PCS 140 to open on a particular tool controller 105, power is interrupted to additional tool controllers located downstream on the transmission path 110.

Downhole tool 145 is coupled to the tool controller 105 through the actuation switch 135. Generally, the downhole tool 145 may be any tool or device capable of performing a particular function or action in a wellbore. For example, the downhole tool 145 may be an explosive setting tool, an electrical setting tool, a sensor initiating memory tool, a hydro-electrical tool, or a fire pipe recovery tool. As an explosive setting tool or electrical setting tool, the downhole tool 145 may: set plugs, set packers, set whipstock plugs, or retrieve plugs. As a sensor initiating memory tool, the downhole tool 145 may be a memory pressure gauge, a memory high-speed pressure gauge, a memory production logging tool, a memory temperature tool, a memory accelerometer, a free point tool, or a logging sensor. As a hydro-electrical tool, the downhole tool 145 may: shift sleeves, set a packer, set plugs, open ports, open laterals, set whipstocks, open whipstock plugs, pull plugs, dump beads, dump sand, dump cement, dump spacers, dump flushes, dump acids, or dump chemicals.

In one implementation, the downhole tool 145 may be a perforating tool system including, for example, a single perforating tool, two or more perforating tools, a tubular string of selectable perforating tools, or a dual fire tool. In the present example, the perforating tool includes an explosive detonator that may be enclosed within a common housing with the tool controller 105. Thus, when the actuation switch 135 is closed by the processor module 125, power is supplied to the perforating tool, actuating the explosive detonator. The resultant explosion may destroy some or all of the perforating tool itself along with the tool controller 105, thereby creating a short-circuit (i.e., over-current) condition on the transmission path 110.

Figure 3:
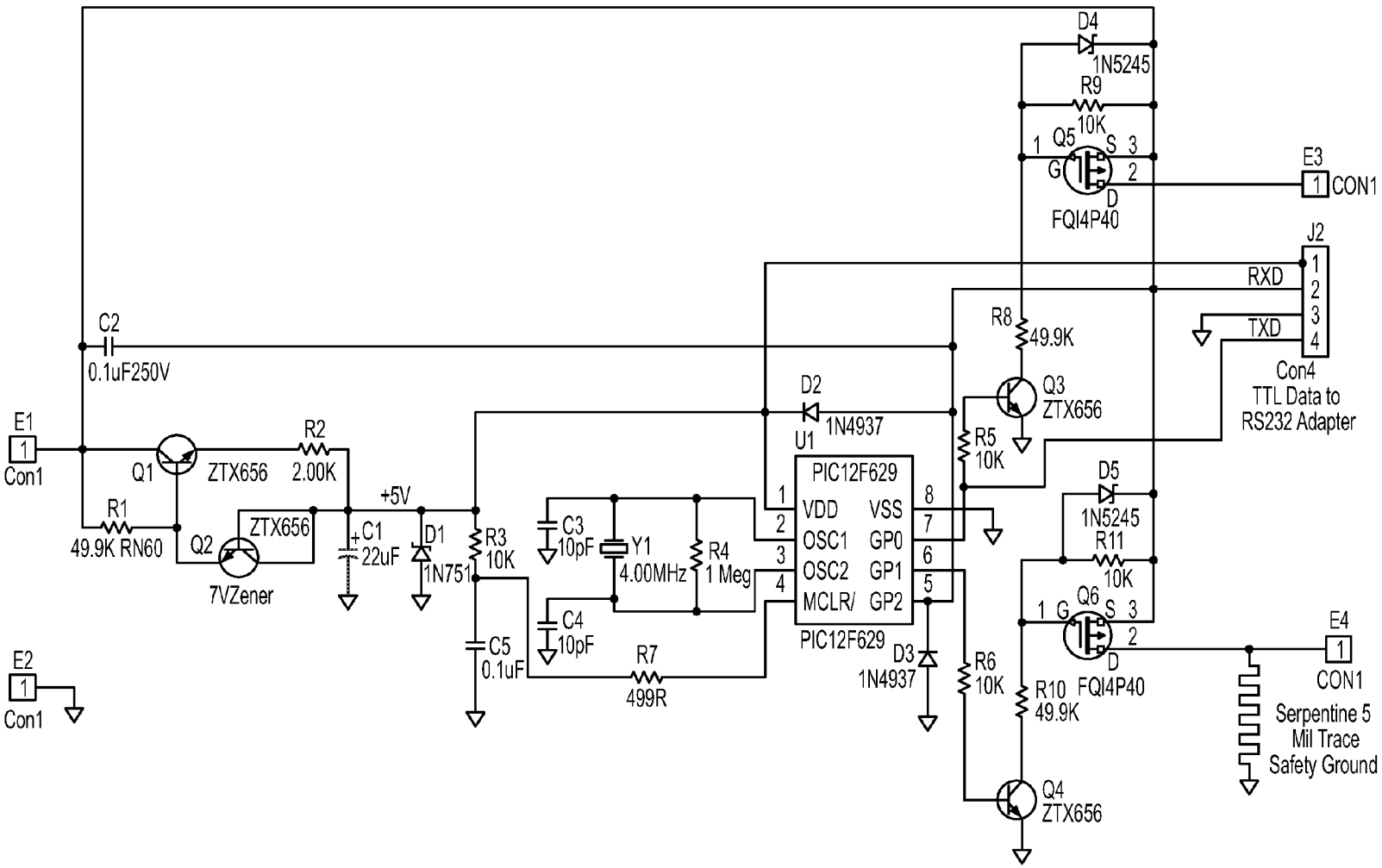
FIG. 3 is a circuit diagram illustrating an example of a downhole device in accordance with the concepts described herein.

FIG. 3 is a circuit diagram illustrating one specific example of a downhole device 200. FIG. 3 illustrates one specific example of a downhole device 200, including resistors, transistors, diodes, capacitors, processor, and switches, other combinations of analog and/or digital circuitry and hardware may also be utilized without departing from the scope of the current disclosure. Generally, downhole device 200, including tool controller 205 and downhole tool 245 may operate similarly to the downhole device 100, including tool controller 105 and downhole tool 145, illustrated in FIG. 2. In some aspects, downhole device 200 may also include a diagnostic module 250, which allows the device 200 to be tested.

Tool controller 205 is coupled to a transmission path 210 and downhole tool 245. Tool controller 205 includes a power module 215, a processor module 225, an actuator switch module 235, and a power-control switch (PCS) module 240. In some embodiments, tool controller 205 may also include a signal conditioner 220.

Power module 215 includes analog and/or digital circuitry (e.g., resistors, transistors (NPN), and capacitors) and is coupled to the transmission path 210 and the processor module 225. Generally, power module 215 receives power via the transmission path 210 and provides power to the components of the tool controller 205, including, for example, the processor module 225.

In some aspects of the present disclosure, the tool controller 205 includes signal conditioner 220. Signal conditioner 220 is coupled to the transmission path 210 and the processor module 225 and, in some aspects, is a single capacitor. Signal conditioner 220, however, may be any combination of analog and/or digital circuitry that receives a tonal signal (e.g., a frequency signal) via the transmission path 210, filters undesirable frequency variations from the frequency signal, and provides a cleaner frequency signal to the processor module 225.

Processor module 225 is coupled to the power module 215, the actuation switch module 235, and the PCS module 240. Further, processor module 225 includes analog and/or digital circuitry (e.g., resistors, diodes, capacitors), a microprocessor 228, and a crystal oscillator 230. Although FIG. 3 illustrates a specific microprocessor 228, a PIC12F629, alternate microprocessor models may also be utilized. As illustrated in FIG. 3, microprocessor 228 may be an eight pin processor. Generally, microprocessor 228 includes software stored in memory executable by the microprocessor 228 to control the tool controller 205. For instance, the microprocessor 228 may receive a tonal signal via the transmission path 210; decode the tonal signal; compare the tonal signal to a stored signal in the microprocessor 228, and control the actuation switch module 235 and the PCS module 240 based on the comparison of such signals. In some aspects, the microprocessor 228 may receive a unique frequency signal via the transmission path 210. "Software," as used in describing the microprocessor 228, may include software, firmware, wired or programmed hardware, or any combination thereof.

The processor module 225 also includes a crystal oscillator 230 coupled to the microprocessor 228 and operable to provide a reliable frequency reference that may be utilized by the microprocessor 228 to perform reliable frequency measurements. For example, if the microprocessor 228 receives a unique frequency signal as a timed serial signal, the crystal oscillator 230 may allow the microprocessor 228 to reliably measure the unique frequency signal. In some implementations, the crystal oscillator 230 is a 4 MHz crystal oscillator as illustrated in FIG. 3.

Tool controller 205 also includes actuation switch module 235, which is coupled to the transmission path 210, the processor module 225, and the downhole tool 245. Actuation switch module 235 includes analog and/or digital circuitry (e.g., resistors, diodes, transistors (NPN)) and an actuation switch 236. Generally, actuation switch module 235 is controlled by the processor module 225 and provides a path for power to be supplied to the downhole tool 245 upon closure. Processor module 225 may close the actuation switch 236 when, for instance, a tonal signal is received via the transmission path 210 and matches a stored signal in the processor module 225.

Continuing with FIG. 3, tool controller 205 also includes PCS module 240 coupled to the transmission path 210 and the processor module 225. PCS module 240 includes analog and/or digital circuitry (e.g., resistors, diodes, transistors (NPN)) and a power-control switch (PCS) 241. Generally, PCS module 240 is controlled by the processor module 225 and provides a path for power to be supplied to, for example, additional downhole devices 200 coupled to the transmission path 210. Processor module 225 may close the PCS 241 when, for instance, the tonal signal is received via the transmission path 210 and does not match the stored signal in the processor module 225.

Downhole device 200 includes downhole tool 245, which is coupled to the actuation switch module 235. In some implementations, as shown in FIG. 3, the downhole tool 245 may be a perforating tool. But downhole tool 245 may be any downhole tool, including those exemplary tools associated with downhole tool 145 illustrated in FIG. 2.

Figure 4:
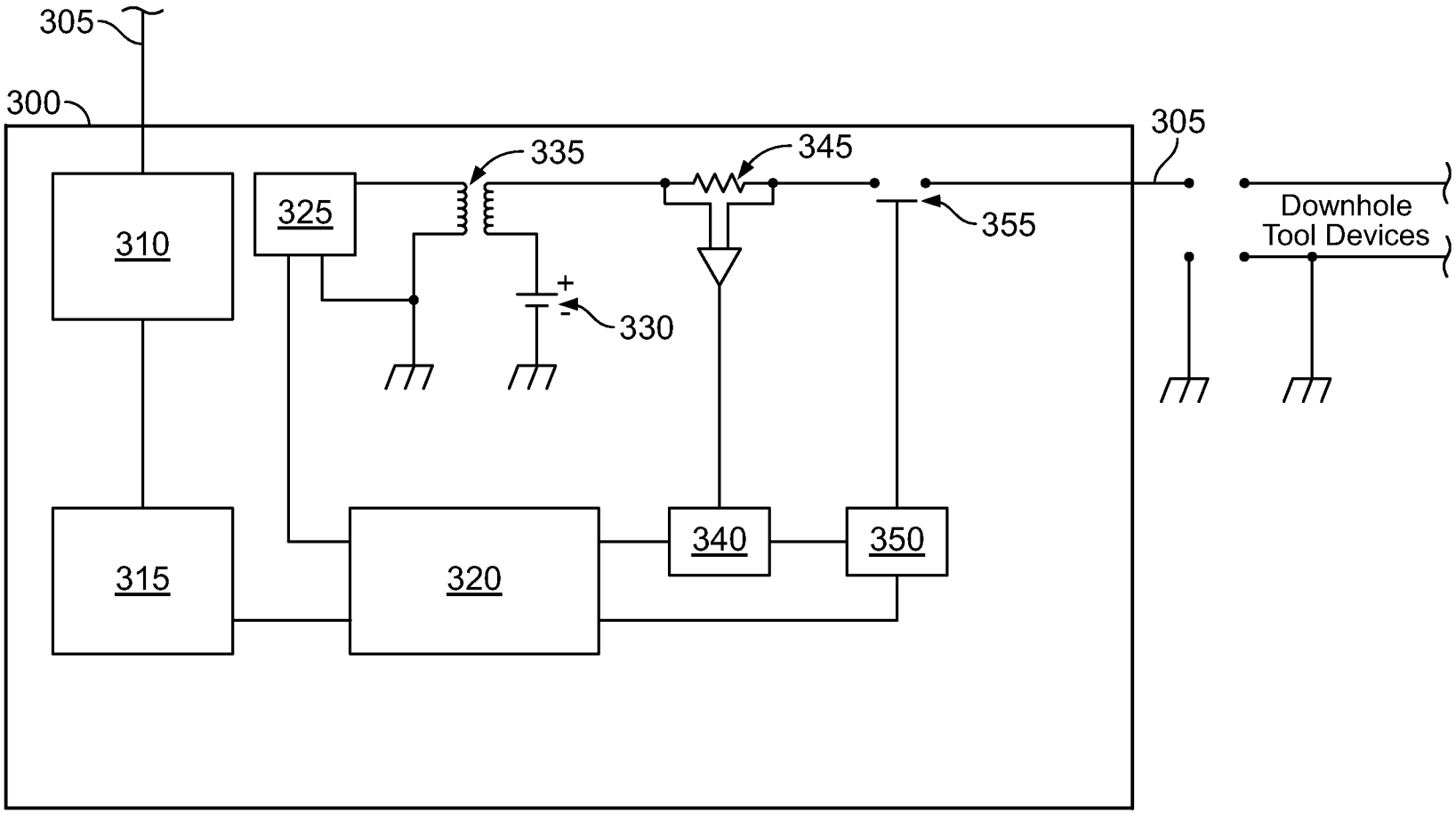
FIG. 4 is a block diagram illustrating an example device for actuating a downhole tool from the surface in accordance with the concepts described herein.

FIG. 4 is a block diagram illustrating one example of a system controller 300 for communicating with one or more downhole devices. In some aspects, system controller 300 may actuate downhole tools 145 or 245 as described in FIGS. 2 and 3. System controller 300 may be located at any location above or below ground, for example at the surface, in the wellbore or elsewhere. Generally, the system controller 300 includes analog and/or digital circuitry, hardware, and software and is operable to generate one or more tonal signals for transmission to one or more downhole devices to actuate one or more downhole tools.

System controller 300 is coupled to a transmission path 305 and includes a power-command module 310, a communications module 315, a control unit 320, a signal generator 325, a power source 330, a transformer 335, an overcurrent detection module 340, a resistor-diode 345, a tool actuator control 350, and a surface switch 355. The transmission path 305 shown in FIG. 4 may be similar to transmission paths 110 and 210 illustrated in FIGS. 2 and 3, respectively. Generally, the transmission path 305 provides a conduit for power (e.g. voltage, current) as well as signals, such as a tonal signal generated by the system controller 300 and transmitted via the transmission path 305 to one or more downhole devices.

Power-command module 310 is coupled to the transmission path 305 and to the communications module 315. Power-command module 310 generally consists of a combination of analog and/or digital circuitry and software and receives commands or instructions through the transmission path 305 from a source remote from the system controller 300 (e.g., wireline truck 14 illustrated in FIG. 1, a logging truck, or other location). Power-command module 310 transmits the commands to the communications module 315 and, in some aspects, may generate commands or other instructions for the system controller 300. Further, power-command module 310 may receive data from the communications module 315, for example, data regarding the operation or availability of one or more downhole tools communicably coupled to the system controller 300.

Communications module 315 is coupled to the power-command module 310 and the control unit 320. Communications module 315, generally, is a transceiver, which receives commands from the power-command module 310 and transmits the commands to the control unit 320. Communications module 315 also receives telemetry data from the control unit 320 and transmits the data to the power-command module 310. In some aspects, communications module 315 may be communicably coupled to the power-command module 310 through wireless communication. Wireless communications between the power-command module 310 and the communications module 315 may be in many formats, such as 802.11a, 802.11b, 802.11g, 802.11n, 802.20, WiMax, RF, and many others.

Control unit 320 is coupled to the communications module 315, the signal generator 325, the overcurrent detection module 340, and the tool actuator control 350. Generally, control unit 320 consists of a combination of analog and/or digital circuitry, and memory and may consist of, in some aspects, one or more microprocessors. Control unit 320 also, generally, receives data and commands from the communication module 315 and the overcurrent detection module 340 and executes software instructions stored in memory to operate the system controller 300. For example, control unit 320 may generate an instruction to the signal generator 325 to produce a tonal signal for transmission to one or more downhole tools. The instruction to the signal generator 325 specifying the tonal signal may be based at least in part on a known depth location of a particular downhole tool (e.g., a perforating gun) in a wellbore. For instance, telemetry data from the communications module 315 may indicate to the control unit 320 that a particular perforating tool within a string of perforating tools is at an ideal depth in the wellbore to perforate a desirable subterranean formation. The tonal signal to signal that particular perforating tool may be preprogrammed into the control unit 320 and/or the signal generator 325. Thus, when an instruction to actuate that particular perforating tool is provided to the control unit 320, it sends an instruction to the signal generator 325 to produce the tonal signal to signal that particular perforating tool.

Continuing with FIG. 4, the signal generator 325 is coupled to the transformer 335 and the control unit 320. Upon receipt of an instruction or command from the control unit 320, the signal generator 325 produces a tonal signal to signal a particular downhole tool communicably coupled with the system controller 300. Thus, when the particular downhole tool receives the tonal signal to which it corresponds, the tool will actuate.

Power source 330, generally, provides power to at least some of the components of the system controller 300. While power source 330, in some aspects, is a DC power source, such as a battery, power source 330 may be any device capable of providing power to the controller 300. For instance, as a battery, the power source 330 may be a lithium battery, alkaline battery, galvanic cells, fuel cells, or flow cells, or other power source. Transformer 335, generally, transfers voltage and/or current within the system controller 300

Over-current detection module 340 is coupled to the resistor-diode 345, the control unit 320, and the tool actuator control 350. Generally, over-current detection module 340 may consist of analog and/or digital circuitry and detects an over-current, or short circuit, condition on transmission path 305 downstream of the system controller (i.e., within the wellbore at a downhole device). For example, a downhole tool may be a perforating tool, which detonates upon actuation. The actuated perforating tool "disappears" both electrically and logically from the transmission path. Over-current detection module 340 may thus detect the short-circuit condition on the transmission path 305 due to the removal by detonation of the actuated perforating tool from the path 205.

Tool actuator control 350 and tool control switch 355 are coupled together and the control unit 320, the over-current detection module 340, and the resistor-diode 345. Generally, the tool actuator control 350 may consist of analog and/or digital circuitry and controls the operation of the tool control switch 355. For example, when the system controller receives a command to actuate a downhole tool, the tool actuator control 350 closes the tool control switch 355, thereby allowing power and the tonal signal to be transmitted to one or more downhole tools via the transmission path 305.

Figure 5:
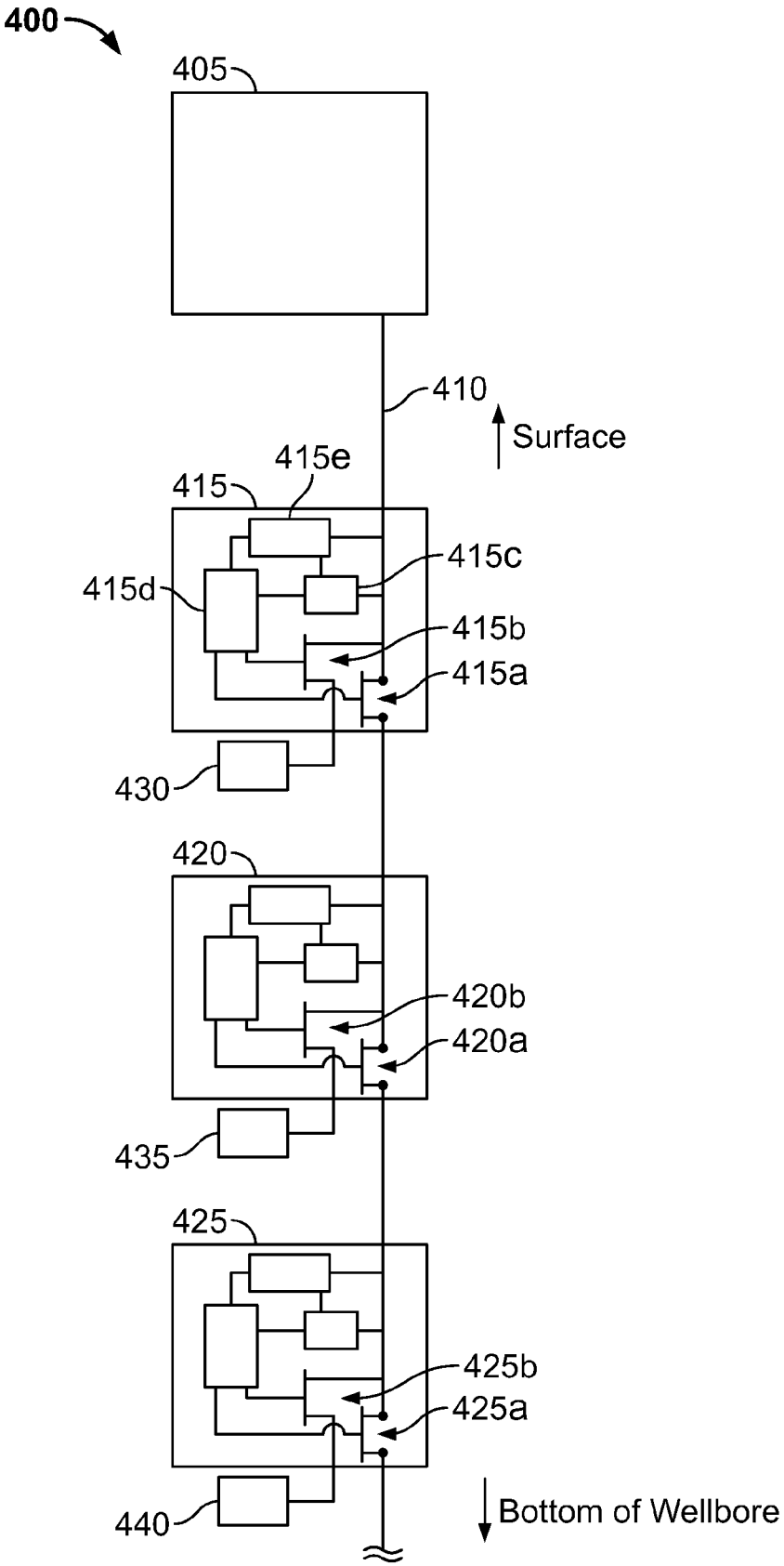
FIG. 5 is a block diagram illustrating an example system for actuating a downhole tool in accordance with the concepts described herein.

FIG. 5 is a block diagram illustrating a system 400 for actuating a downhole tool including a system controller 405, a transmission path 410, multiple downhole tool controllers 415, 420, and 425, and multiple downhole tools 430, 435, and 440. In some implementations, the general operation and configuration of the components in system 400 may be substantially similar to corresponding components described with reference to FIGS. 1-4. For example, downhole tool controller 415 includes a PCS 415*a*, an actuation switch 415*b*, a signal conditioner 415*c*, a processor module 415*d*, and a power module 415*e*. Downhole tool controllers 420 and 425 include similar components, such as PCS 420*a* and 425*a*, respectively, and actuation switch 420*b* and 425*b*, respectively.

Generally, the operation of the system 400 is similar to that described with reference to the previous figures. For example, the system controller 405 may generate a tonal signal capable of signaling downhole tool 440. The tonal signal is transmitted first to downhole tool controller 415 via the transmission path 410. Downhole tool controller 415 receives the tonal signal and, determining that the particular tonal signal does not match a signal specified for signaling downhole tool 430, closes PCS 415*a*. The tonal signal is thereby transmitted to the downhole tool controller 420. Downhole tool controller 420 receives the tonal signal and may also determines that the particular tonal signal does not match a signal specified for signaling downhole tool 435, closes PCS 420*a*. Thus, the tonal signal is transmitted to the downhole tool controller 425. The downhole tool controller 425, however, determining that the tonal signal does actuate downhole tool 440, closes the actuation switch 425, thereby providing sufficient actuating power to the downhole tool 440. Once the downhole tool 440 actuates, the system controller 405 may generate another tonal signal, such as a signal for signaling the downhole tool 435, which begins the previously described process again.

Figure 6:
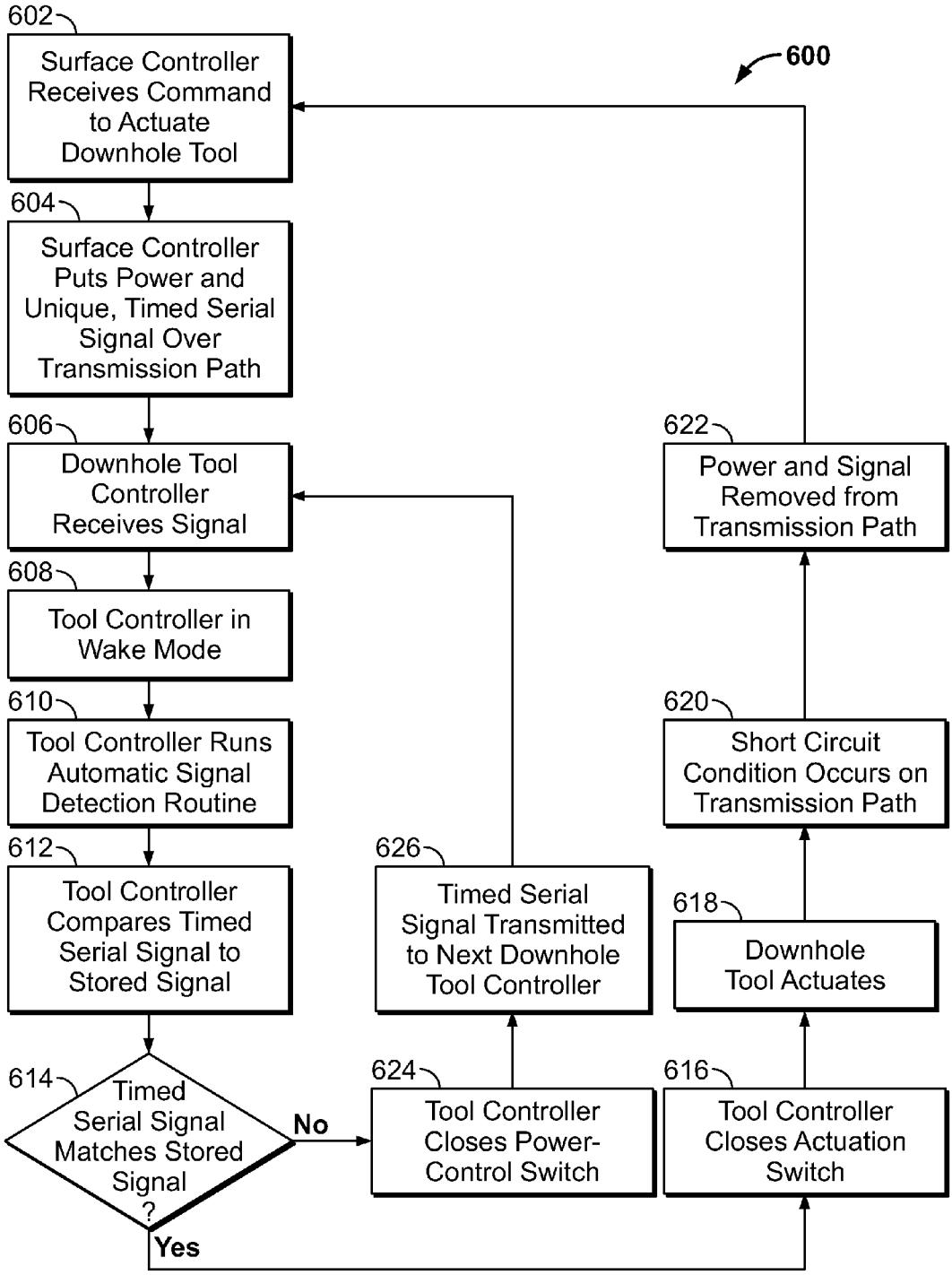
FIG. 6 is a flowchart illustrating an example method for actuating a downhole tool in accordance with the concepts described herein.

FIG. 6 is a flowchart illustrating an example method 600 for actuating a downhole tool. Method 600 may be implemented by a system for signaling a downhole tool, for example, system 400, including a system controller, a transmission path, one or more downhole tool controllers, and one or more downhole tools. For instance, a system controller receives a command to actuate a downhole tool [602]. Once the system controller receives the command to actuate the downhole tool, the system controller puts power and a tonal signal over a transmission path [604]. In some implementations, the command received by the system controller (e.g. from an operator or another system) may specify the tonal signal to be transmitted by the system controller. But the system controller may also determine the specific, tonal signal to be transmitted through a preprogrammed software routine or schedule.

A downhole tool controller receives power and the tonal signal via the transmission path [606]. In certain aspects including multiple downhole tools, the downhole tool controller closest to the system controller may first receive power and the tonal signal. The downhole tool controller then enters a "wake" mode [608]. In the wake mode, the downhole tool controller may begin a preprogrammed diagnostics routine, or otherwise prepare itself to execute its software routines and instructions. In the wake mode, the downhole tool controller executes an automatic signal detection routine [610]. Generally, a microprocessor or other circuit executes the signal detection routine according to the preprogrammed software residing in the downhole tool controller.

The downhole tool controller compares the received tonal signal with a stored signal on the controller [612]. For instance, in some aspects, the tonal signal may be a signal at a specific frequency for a specific duration. Thus, the downhole tool controller compares the frequency and duration of the signal to the stored signal frequency and duration characteristics in order to determine whether the received signal matches the stored signal [614]. If the signals match, the downhole tool controller closes an actuation switch in the controller [616]. In some aspects, the actuation switch is in an open or off state when the downhole tool controller enters the wake mode. Upon closure of the actuation switch, power is supplied to the downhole tool, which is coupled to the downhole tool controller, and the downhole tool actuates [618]. Once actuated, a short-circuit condition may occur on the transmission path [620]. For instance, the downhole tool may be a perforating tool, which detonates upon actuation. Thus, the actuated perforating tool "disappears" both electrically and logically from the transmission path. Additionally, once a particular perforating tool disappears, the system controller may detect the over-current condition and remove power from the transmission path [622], until the system controller receives a next command to actuate a downhole tool [602].

Further, in some aspects, should one downhole tool within a string actuate, an adjacent downhole tool nearer to the surface within the string may automatically determine that downhole tools lower than the actuated tool in the string should not be actuated until the system controller transmits an additional signal. For example, the adjacent downhole tool may include integrated firmware within the corresponding downhole tool controller that stores a binary (i.e., 1 or 0) digit indicating whether the lower downhole tool was actuated. In some aspects, therefore, the built-in firmware may store a 1 to indicate that tools lower than the actuated downhole tool should not be actuated without an additional signal from the system controller.

If the signals do not match (i.e., either the frequency or duration do not match), the downhole tool controller closes a power-control switch of the controller [624]. Once closed, power and the tonal signal is transmitted via the transmission path to a next downhole tool controller (e.g., a downhole tool controller coupled to the transmission path lower in the wellbore) [626]. The next downhole tool controller receives power and the tonal signal [606], and completes operations previously described [608]-[614]. In some aspects, the power-control switch is in an open or off state when the downhole tool controller enters the wake mode.

Although FIG. 6 illustrates one method for actuating a downhole tool, other downhole tool actuating methods may include fewer and/or a different order of operations. Moreover, some operations in method 500 may be done in parallel to other operations.

A number of implementations have been described. Nevertheless, it will be understood that various modifications may be made. Accordingly, other implementations are within the scope of the following claims.

What is claimed is:

1. A downhole tool system, comprising:

a downhole device comprising:

a downhole tool; and a controller operable to receive an actuation signal comprising a tone, the controller actuates the downhole tool if the tone is a specified frequency and of a specified duration associated with the downhole device.

2. The downhole tool system of claim 1, wherein the downhole device is a first downhole device, the downhole tool is a first downhole tool, the controller is a first controller, the specified frequency is a first specified frequency, and the specified duration is a first specified duration;

the downhole tool system further comprising a second downhole device comprising a second downhole tool and a second controller operable to receive the actuation signal; and the second controller actuates the second downhole tool if the tone is a second specified frequency and of a second specified duration associated with the second downhole device, the second frequency being different from the first specified frequency and the second specified duration being different from the first specified duration.

3. The system of claim 2, wherein the first controller changes the first downhole device to communicate the actuation signal to the second downhole device if the first downhole tool is not actuated in response to the actuation signal.

4. The system of claim 2, wherein the first downhole device receives actuation power and the first controller changes the first downhole device to provide actuation power to the second downhole device if the first downhole device is not actuated in response to the actuation signal.

5. The system of claim 2, further comprising:

a third downhole device comprising a third downhole tool and a third controller operable to receive the actuation signal; and the third controller actuates the third downhole tool if the tone is a third specified frequency associated with the third downhole device, the third specified frequency being different from the first and second specified frequencies.

6. The system of claim 2, wherein the first and the second downhole tools comprise perforating tools.

7. The system of claim 1, wherein the specified frequency is different from any other frequency associated with any other downhole device of the downhole tool system.

8. The system of claim 1, further comprising a mono-conductor wireline communicating the actuation signal and power to actuate the downhole tool to the downhole device.

9. The system of claim 8, wherein the downhole device further comprises a metallic housing that provides a ground reference relative to the mono-conductor wireline.

10. The system of claim 1, wherein the actuation signal comprises a plurality of tones and wherein the controller actuates the downhole device if the tones comprise a specified plurality of frequencies associated with the downhole device.

11. The downhole tool system of claim 1, wherein the controller is operable to compare a duration of the tone to the specified duration of the tone.

12. The downhole tool system of claim 11, wherein the controller is operable to actuate the downhole tool when the duration of the tone is substantially equal to the specified duration.

13. A method for actuating a downhole tool in a well bore, comprising:

receiving, at the downhole tool, a tonal signal and power for actuating the downhole tool on a common conductor;

determining whether the tonal signal corresponds to the downhole tool by comparing a frequency of the tonal signal to a reference frequency uniquely associated with the downhole tool and by comparing a duration of the tonal signal to a specified duration; and based upon the determination of whether the tonal signal corresponds to the downhole tool, changing the downhole tool to apply the power to actuate the downhole tool.

14. The method of claim 13, further comprising, based upon the determination of whether the tonal signal corresponds to the downhole tool, changing the downhole tool to communicate the power and the tonal signal to another downhole tool.

15. The method of claim 13, wherein determining whether the tonal signal corresponds to the downhole tool further comprises comparing a plurality of frequencies of the tonal signal to a plurality of reference frequencies associated with the downhole tool.

16. The method of claim 13, wherein the downhole tool is a perforating tool.

17. A method, comprising:

receiving, at a downhole tool, power for tool actuation and an actuation signal comprising a tone;

comparing the actuation signal to a reference frequency associated with the downhole tool; and actuating the downhole tool in response to the comparison of the actuation signal and the reference frequency if a tone of the actuation signal substantially matches the reference frequency, wherein actuating the downhole tool further comprises actuating the downhole tool in response to the comparison of the actuation signal and the reference frequency and a comparison of a duration of the tone and a specified duration associated with the downhole tool.

18. The method of claim 17, wherein the reference frequency is different from any other frequency associated with any other downhole tool in communication with the downhole tool.

* * * * *